United States Patent [19]

Bodele et al.

[11] Patent Number: 4,620,880

[45] Date of Patent: Nov. 4, 1986

[54] PROCESS FOR PRODUCING CRYSTALLINE DEXTROSE MONOHYDRATE

[75] Inventors: Gilbert Bodele, Hazebrouck; Pierrick Duflot; Bernard Valentin, both of La Gorgue; Michel Huchette, Merville, all of France

[73] Assignee: Roquette Freres, France

[21] Appl. No.: 670,489

[22] Filed: Nov. 13, 1984

[30] Foreign Application Priority Data

Nov. 17, 1983 [FR] France ..... 83 18318

[51] Int. Cl.[4] ..... C13F 1/02

[52] U.S. Cl. ..... 127/60; 127/15; 422/202; 422/225; 422/254

[58] Field of Search ..... 127/15, 30, 58, 60, 127/18, 59, 61, 62; 422/202, 225, 245, 254

[56] References Cited

U.S. PATENT DOCUMENTS

| | | | |
|---|---|---|---|
| 1,021,173 | 3/1912 | Wiese | 127/15 X |
| 2,800,411 | 7/1957 | Church | 422/254 X |
| 2,823,242 | 2/1958 | McKay | 422/254 X |
| 3,617,382 | 11/1971 | Natsis | 127/15 |
| 4,194,557 | 3/1980 | Madsen | 127/15 X |
| 4,357,172 | 11/1982 | Edwards | 127/30 X |
| 4,404,038 | 9/1983 | Credoz et al. | 127/60 |

FOREIGN PATENT DOCUMENTS

| | | |
|---|---|---|
| 727378 | 1/1969 | Belgium . |
| 1642536 | 5/1971 | Fed. Rep. of Germany . |
| 1154584 | 4/1958 | France . |
| 12955543 | 5/1962 | France . |
| 1210512 | 10/1970 | United Kingdom . |

*Primary Examiner*—Richard V. Fisher
*Assistant Examiner*—W. Gary Jones
*Attorney, Agent, or Firm*—Larson and Taylor

[57] ABSTRACT

A process for the production of crystalline dextrose monohydrate in which the mass M subjected to crystallization traverses from above downwards continuously and under malaxation, a vessel inside which it is subjected to a temperature gradient globally decreasing from above downwards. The crystalline mass is recovered continuously at the lower part of the vessel, means being provided to take up at the intermediate level a fraction of the mass and to recycle it to a level situated in the vicinity of the upper end of the vessel.

9 Claims, 1 Drawing Figure

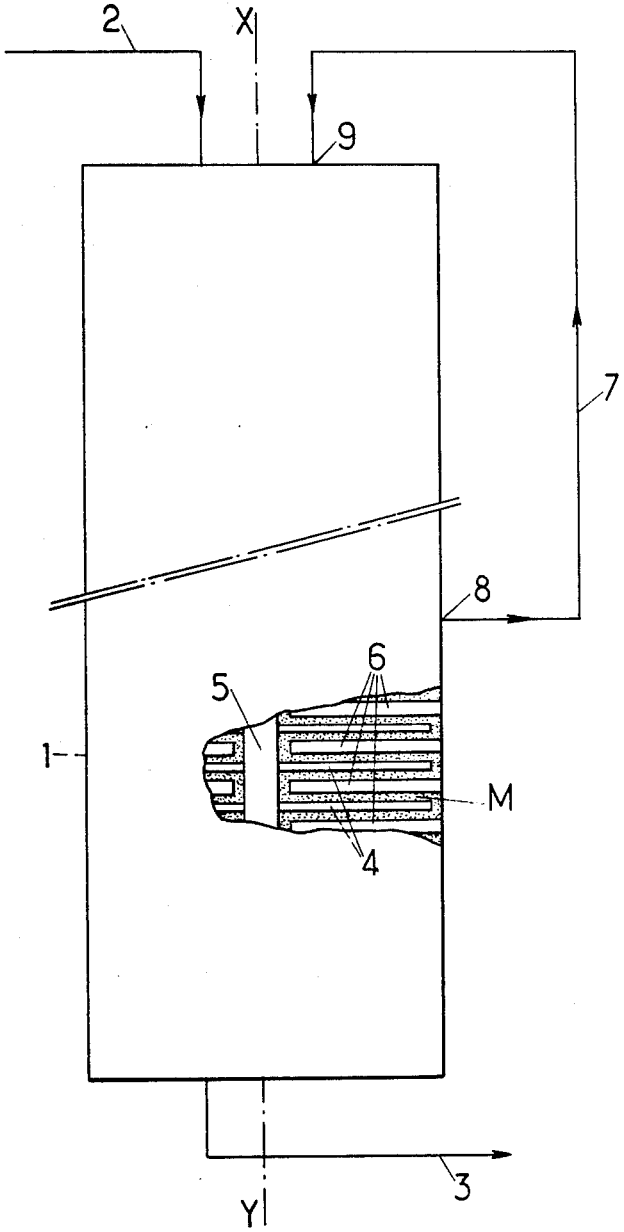
2
X
9
7
8
6
5
1
M
4
3
Y

PROCESS FOR PRODUCING CRYSTALLINE DEXTROSE MONOHYDRATE

BACKGROUND OF THE INVENTION

The invention relates to a process and an installation for producing crystalline dextrose monohydrate.

It is known to prepare crystalline dextrose monohydrate by cooling dextrose-rich syrups in the presence of dextrose crystals which play the role of crystallization seed.

Known processes provide for the simultaneous employment of several devices of the malaxation type, arranged horizontally or vertically; these devices are equipped with stirring means and with means for regulating the temperature adapted to establish a temperature gradient decreasing in the mass subjected to crystallization, which is comprised by the syrup and the seed.

The last developments of these processes are reflected particularly by U.S. Pat. No. 4,357,172, filed the Dec. 16, 1980 and assigned to the Company CPC INTERNATIONAL INC., which provides a preparation in two steps; thus a first step, with continuous operation, provides, at the outlet from a first malaxator, a mixture of syrup and crystals relatively little enriched in crystals, denoted in the technique by the expression "poor phase massecuite"; the latter is then transferred in the second step to at least one second malaxator with discontinuous operation and providing a mixture highly enriched in crystals which is denoted by the expression "rich phase massecuite"; it is from the latter that the dextrose crystals are finally recovered.

These processes do not give entire satisfaction either from the point of view of productivity per unit volume of equipment or from that of the energy balance.

Now, to meet the always more severe constraints, particularly in the economic field, Applicants have sought to develop a process and an installation of the type concerned which responds better than those already existing to the various desiderata of practice, in particular precisely from the point of view of productivity of the crystallization operation per unit volume of equipment used and of the energy balance.

GENERAL DESCRIPTION OF THE INVENTION

Applicants have discovered that this object could be reached by means of a process of the type concerned in which the mass subjected to crystallization traverses from above downwards, continuously and with malaxation, a crystallization zone of vertical or inclined direction, in whic there is established a temperature gradient overall or globally decreasing downwards, said process being characterized by the fact that the crystallization zone is supplied in the vicinity of its upper end, on the one hand with glucose syrup having a richness in glucose higher than 60% and a dry matter content higher than 55% and, on the other hand with mass subjected to crystallization which is taken up and recycled from an intermediate level of the crystallization zone, distant from its ends by at least one sixth of the total length of said zone, the amount of mass subjected to crystallization which is recycled representing in volume from 10 to 40% of the amount of glucose syrup introduced into the zone and that there is extracted, continuously, in the vicinity of the lower end of the crystallization zone, a product highly enriched in dextrose monohydrate crystals from which said crystals are recovered.

To employ the abovesaid process, recourse is had, in accordance with the invention, to an installation constituted essentially by a crystallization vessel of vertical or inclined axis and equipped with a system supplying glucose syrup in the vicinity of its upper end, with a malaxation system and with a temperature regulation system adapted to establish inside the vessel and within the mass subjected to crystallization contained in the vessel a temperature gradient overall or globally decreasing from above downwards, and with a system for continuous extraction, in the vicinity of its lower end, of a product highly enriched in dextrose monohydrate crystals which is carried by suitable means to a system adapted to recover the crystals from this product, said installation being characterized by the fact that it comprises means adapted to take up at an intermediate level of the vessel, distant from the ends of the latter by at least one sixth of its total length, an amount of mass subjected to crystallization, which corresponds, in volume, to 10 to 40% of the amount of glucose syrup introduced in the vicinity of the upper end of the vessel, said means, which are adapted to take up the mass subjected to crystallization, being in addition adapted to recycle it into the vessel at a level in the vicinity of the upper end of the latter.

The invention relates also to other features which are preferably used at the same time and which will be more explicitly considered below.

And it will, in any case, be well understood by means of the additional description that follows and the accompanying drawing which relate to preferred embodiments of the invention.

The single FIGURE of the drawing shows diagramatically an installation according to the invention.

In order, consequently, to produce crystalline dextrose monohydrate according to the invention, procedure is as follows or in equivalent manner.

DESCRIPTION OF PREFERRED EMBODIMENT

As raw material glucose syrups are used derived from acid and/or enzymatic hydrolysis of starch, having a content of dry matter of about 55 to 85% by weight, the glucose entering for at least 60% and, preferably, for a proportion higher than 90% by weight, into the constitution on dry matter of the syrup.

This concentrated syrup is led to a vertical or inclined crystallization zone, which it traverses continuously from above downwards from a point situated in the vicinity of its upper end and within which it is subjected, in the presence of dextrose crystals playing the role of crystallization seed, to malaxation and to a temperature gradient overall decreasing from above downwards.

The temperature of the syrup is brought or maintained, at the moment of its introduction into the crystallization zone, at a value selected within the interval of 30° to 70° C., preferably from 35° to 55° C. and, in practice, in the vicinity of 40° to 50° C.

The temperature gradient established inside the crystallization zone within the mass subjected to crystallization corresponds to a reduction of 0.5° to 5° C., preferably from 2° to 4° C. per linear meter of the crystallization zone and is such that at the exit from said zone, at a point situated in the vicinity of the lower end of the latter, the mass subjected to crystallization which comprises the syrup, the crystals initially present and those formed by the crystallization phenomenon are brought to a temperature situated within an interval of 15° to 40° C., preferably from 20° to 30° C.

Progressively as the mass subjected to crystallization approaches the lower end of the crystallization zone, its richness in dextrose monohydrate crystals increases, said mass forming at the exit of the zone a "rich phase massecuite".

The production, in the vicinity of the lower end of the crystallization zone of a rich phase massecuite which can be extracted continuously without disturbing the parameters of the crystallization process which disturbance would have repercusions at the level of the following step of separation of the liquid phase and of the crystals and which would necessitate intermittent stoppages of the installation, in other words the placing at the disposal of the user of a process enabling a productivity to be reached per unit volume of the equipment used which had never been obtained, is rendered possible, according to the invention, by means of the taking up, at an intermediate level of the crystallization zone, distant from the ends of the latter by at least one sixth of the total length, of a fraction of the mass subjected to crystallization which is recycled and reintroduced into the crystallization zone at a level in the vicinity of its upper end.

The fraction taken up and recycled presents, in volume, from 10 to 40%, preferably from 25 to 35% of the volume of glucose syrup supplying the crystallization zone.

The flow-rate of the glucose syrup supply is selected so that the statistical or theoretical mean dwell-time of a given fraction of the mass subjected to crystallization within the crystallization zone is from 10 to 40 hours, preferably from 20 to 30 hours, the value adopted depends on the heat exchange capacities of the means comprised by the zone and by means of which is established, inside said zone within the mass subjected to crystallization, the decreasing temperature gradient.

The intermediate level at which is carried out the taking up of the fraction subjected to crystallization and which is destined for recycling, is preferably spaced from the ends of the crystallization zone by at least one quarter of the total length of the latter and, in practice, of the order of at least two fifths of the total length of said zone.

The viscosity of the mass subjected to crystallization which increases progressively as the proportion of dextrose monohydrate crystals grows, that it to say that in the descending direction, requires the crystallization zone to be, preferably, equipped with driving or suction means adapted to ensure the routing of the mass inside the zone, as gravity alone can be insufficient.

In addition, the malaxation and homogenation means comprised by the crystallization zone must be arranged so that dead zones are avoided and that the heat exchange between the mass subjected to crystallization and the cooling means is globally of the turbulent type.

The product extracted from the crystallization zone which constitutes, as already indicated, a rich phase massecuite, comprises the dextrose monohydrate crystals of a granulometric spectrum characterized by a low proportion of fine and coarse crystals and hence by a high proportion of crystals of intermediate size, this spectrum not varying over time, due to which the following treatment step which consists of separating these crystals from the liquid phase in which they are immersed, does not experience disturbance.

This separation comprises spinning or centrifugation and possibly clarification due to which the major part of the liquid phase is recovered; the latter forms hydrols whose dextrose concentration is less than that of the starting glucose syrup—this concentration generally reaches from 70 to 85%—and in which is found again almost the whole of the di, tri- and polysaccharides contained in the starting glucose syrup.

The hydrols collected can be recycled.

This being the case, to practice the process according to the invention, recourse may be had to a single vessel 1 having the shape of a cylinder of revolution of axis XY.

The axis XY is arranged advantageously along the vertical but may also be inclined.

The vessel is equipped with a glucose syrup supply system at the level of the upper end of the vessel and shown diagramatically by a pipe 2, a system of malaxation and regulation of the temperature which will be further discussed and a continuous extraction system at the level of the lower end of the vessel shown diagramatically by pipe 3, this system being adapted to recover the rich phase massecuite obtained at the exit of the crystallization zone; this extraction system can include aspiration means (not shown) which cooperate to cause the mass subjected to crystallization to traverse the vessel.

The system of malaxation and regulation of temperature which has been mentioned above may advantageously include a set of malaxation arms 4 borne at regular intervals by a rotary shaft 5 whose axis is merged with the axis XY of the vessel, cooling sheets 6 arranged in alternation with the malaxator arms 4 and borne by the wall of the vessel 1, these cooling sheets being traversed by a cooling fluid.

In accordance with the invention, the vessel comprises in addition means shown as a whole at 7 and adapted to take up at an intermediate level 8 of the vessel, spaced from the ends of the vessel by at least one sixth of the total length of the vessel, a fraction of the mass M subjected to crystallization and traversing the vessel from above downwards and to recycle this fraction to a level 9 situated in the vicinity of the upper end of the vessel.

The heat exchange capacity of the temperature regulating system, the rotary speed of the malaxation means and the speed with which, under the influence of the aspiration means (not shown), the mass subjected to crystallization traverses the vessel, that is to say the average dwell-time of a given fraction of this mass inside the vessel, are selected so that there is established, within the whole of the mass subjected to crystallization, the temperature gradient provided according to the invention.

It is pointed out that, in practice, the cooling fluid is water and that the mean deviation in temperature at a given point of the vessel between this water and the mass subjected to crystallization, is of the order of 6° to 12° C.

EXAMPLE 1

Recourse is had to an installation according to the invention comprising a single cylindrical vessel of useful volume of 48 $m^3$ for a height of 8 meters.

Into this vessel is introduced, with a flow-rate of 1.8 $m^3$ per hour, a glucose syrup having a dry matter content of 74% and comprising 94% by weight on dry matter of glucose, the remaining 6% being constituted by polysaccharides.

The temperature of the syrup at the inlet of the vessel is about 50° C.

Simultaneously there is recycled, with a flow-rate of 0.5 $m^3$ per hour, a fraction of the mass in the course of crystallization taken up at a substantially middle level of the vessel.

The mean passage time inside the vessel of a given fraction of the mass subjected to crystallization is about 25 hours.

The rich phase massecuite extracted at the level of the lower end of the vessel is at a temperature close to 25° C., the temperature gradient overall decreasing from above downwards corresponding therefore to about 3.2° C. per meter.

The glucose content of the hydrols recovered after separation of the dextrose monohydrate crystals is 84% on dry matter, the complement to 100 being constituted by polysaccharides.

The crystallization yield which is given by the formula:

$$r = \frac{A - H}{100 - H}$$

in which

A is the richness in glucose of the feed-syrup,

H the richness in hydrol, is established at 62.5%.

Daily 26.6 tons of dextrose monohydrate are produced, which corresponds to a productivity of 0.55 tons daily and per $m^3$ of the vessel.

This result must be compared with that obtained on crystallization of the same glucose syrup in a horizontal reactor whose productivity is established at 0.3 tons per $m^3$ of the vessel, daily.

In addition, no disturbance, necessitating stoppage of the installation, is produced which hence operates continuously.

The crystals collected after spinning and clarification show excellent physical and chemical properties.

These crystals are of 99.5% purity, their flow-index is good and their granulometric distribution is as follows:

| | |
|---|---|
| crystals of size over 100 microns | 38% |
| crystals of size comprised between 60 and 80 microns | 16% |
| crystals of size comprised between 80 and 100 microns | 18% |

EXAMPLE 2

The apparatus and the operational conditions of Example 1 were used.

However at a given moment, after a certain number of hours of operation, the recycled fraction was taken up, no longer at an intermediate level but at a point of the vessel situated in the last sixth of the total height.

There is then rapidly witnessed a change in the parameters of crystallization which is manifested after some hours by poor separation at the level of the turbines and which ends in necessitating the stoppage of the installation and the removal of the mass that it contains before starting up again under the conditions according to the invention.

As is self-evident and as emerges already besides from the foregoing, the invention is in no way limited to those of its types of application and embodiments which have been more particularly envisaged; it encompasses, on the contrary, all modifications.

We claim:

1. Process for the production of crystalline dextrose monohydrate which comprises supplying to a vertical or inclined crystallization zone in the vicinity of its top or upper end, glucose syrup having a glucose richness higher than 60% and dry matter content above 55%, establishing a temperature gradient globally decreasing from the top to the bottom or lower end of said zone, seeding said glucose syrup with dextrose crystals, allowing said mixture of glucose syrup and dextrose seed crystals which constitutes a crystallization product to traverse said crystallization zone from the top to the bottom under malaxation, its richness in dextrose monohydrate crystals increasing during the passage from the top to the bottom of the crystallization zone, extracting, continuously, in the vicinity of the lower end of the crystallization zone, a crystallization product highly enriched in dextrose monohydrate crystals from which said crystals are recovered, and recycling to the upper end of said crystallization zone from an intermediate level spaced from the ends of said zone by at least two-fifths of its total length, an amount of crystallization product representing by volume from 10 to 40% of the amount of the glucose syrup supplied to the top of the crystallization zone.

2. Process according to claim 1, wherein the amount of recycled crystallization product represents by volume from 25 to 35% of the volume of the glucose syrup supplied to the top of the crystallization zone.

3. Process according to claim 1, comprising selecting the temperature of the glucose syrup supplied to the top of the crystallization zone at the moment of supply in the range from 30° to 70° C., selecting for the temperature gradient established inside the crystallization zone a reduction of temperature of 0.5° to 5° C. per linear meter of the crystallization zone, and bringing the temperature of the crystallization product highly enriched in dextrose monohydrate crystals in the vicinity of the lower end of the crystallization zone to a value situated within an interval of 15° to 40° C.

4. Process according to claim 1, comprising selecting the temperature of the glucose syrup supplied to the top of the crystallization zone, at the moment of supply in the range from 35° to 55° C., selecting for the temperature gradient established inside the crystallization zone a reduction of temperature of 2° to 4° C. per linear meter of the crystallization zone, and bringing the temperature of the crystallization product highly enriched in dextrose monohydrate crystals in the vicinity of the lower end of the crystallization zone to a value situated within an interval of 20° to 30° C.

5. Process according to claim 1, comprising selecting the temperature of the glucose syrup supplied to the top of the crystallization zone, at the moment of supply in the range close to 40° to 50° C., selecting for the temperature gradient established inside the crystallization zone a reduction of temperature of 2° to 4° C. per linear meter of the crystallization zone, and bringing the temperature of the crystallization product highly enriched in dextrose monohydrate crystals in the vicinity of the lower end of the crystallization zone to a value situated within an interval of 20° to 30° C.

6. Process according to claim 1, wherein the statistical or theoretical mean dwell-time of a given fraction of the crystallization product inside the crystallization zone is 10 to 40 hours.

7. Process according to claim 1, wherein the statistical or theoretical mean dwell-time of a given fraction of the crystallization product inside the crystallization zone is 20 to 30 hours.

8. Process according to claim 1, wherein the glucose syrup serving as raw material has a content of dry matter of about 55 to 85% by weight, the glucose forming at least 60% by weight of the dry matter of the syrup.

9. Process according to claim 1, wherein the glucose syrup serving as raw material has a content of dry matter of about 55 to 85% by weight, the glucose forming a proportion higher than 90% by weight of the dry matter of the syrup.

* * * * *